United States Patent [19]

Larson

[11] 4,017,697

[45] Apr. 12, 1977

[54] KEYBOARD MEMBRANE SWITCH HAVING THRESHOLD FORCE STRUCTURE

[75] Inventor: Willis August Larson, Mequon, Wis.

[73] Assignee: Globe-Union Inc., Milwaukee, Wis.

[22] Filed: Sept. 15, 1975

[21] Appl. No.: 613,254

[52] U.S. Cl. ..... 200/5 A; 200/159 B

[51] Int. Cl.[2] ..... H01H 13/52; H01H 1/50

[58] Field of Search ..... 200/5 R, 5 A, 159 B, 200/264, 265, 275

[56] References Cited

UNITED STATES PATENTS

| | | | |
|---|---|---|---|
| 3,668,337 | 6/1972 | Sinclair | 200/159 B X |
| 3,699,294 | 10/1972 | Sudduth | 200/159 B X |
| 3,721,778 | 3/1973 | Seeger, Jr. et al. | 200/159 B X |
| 3,728,509 | 4/1973 | Shimojo | 200/159 B |
| 3,745,287 | 7/1973 | Walker | 200/159 B |
| 3,860,771 | 1/1975 | Lynn et al. | 200/159 B X |
| 3,862,382 | 1/1975 | Glaister et al. | 200/159 B |
| 3,898,421 | 8/1975 | Suzumura | 200/159 B |
| 3,941,953 | 3/1976 | Misson et al. | 200/5 A X |

*Primary Examiner*—James R. Scott

*Attorney, Agent, or Firm*—David B. Smith; John Phillip Ryan

[57] ABSTRACT

A keyboard membrane switch including the standard three layer resilient flexible diaphragm switch construction. Threshold pressure is applied to the membrane prior to engagement of the membrane contact with at least one fixed contact. This phenomenon is achieved by applying variable thicknesses of nonconductive threshold paint or glass to the substrate, flexible membrane, a first layer of threshold material or any combination thereof.

17 Claims, 10 Drawing Figures

KEYBOARD MEMBRANE SWITCH HAVING THRESHOLD FORCE STRUCTURE

BACKGROUND OF THE INVENTION

The present invention relates generally to switches and more specifically to membrane switches in which a sheet-like membrane is supported adjacent one or more pairs of electrical contacts or electrodes. Such switches may include a spacer for supporting the membrane in a spaced relationship relative to one or both electrodes of each pair. The spacer will generally include an aperture through which the membrane may be depressed into contact with the electrode pairs to form an electrical bridge. In the past, such switches have utilized spacers formed from discreet nonconductive sheets of material. Additionally, in some membrane switch applications it may be desirable to have different threshold pressures or actuating forces required to be imposed upon the membrane in order to contact the electrode pairs. In the past, threshold variations were provided by varying such factors as spacer thickness, membrane material itself and membrane thickness.

SUMMARY OF THE INVENTION

It is an object of the invention to provide an improved membrane switch apparatus which may be easily manufactured.

A further object of the invention is to provide a membrane switch apparatus in which the threshold pressure for actuating the switch may be easily varied between different switches utilizing the same basic component materials.

These and other objects and advantages of the present invention will become apparent from the description of preferred embodiments which follows. The invention basically comprises a membrane switch apparatus in which a nonconductive paint or glass is utilized to provide spacing between the membrane and one or more switch electrodes mounted on a substrate. Nonconductive paint or glass may also be utilized to form an obstruction between the path of movement of the membrane into contact with the electrodes for providing a threshold feature in the switch. The threshold pressure may be varied by adjusting the thickness of the threshold paint or glass or the area covered by the nonconductive threshold material.

DESCRIPTION OF THE PREFERRED EMBODIMENTS

Figure 1:
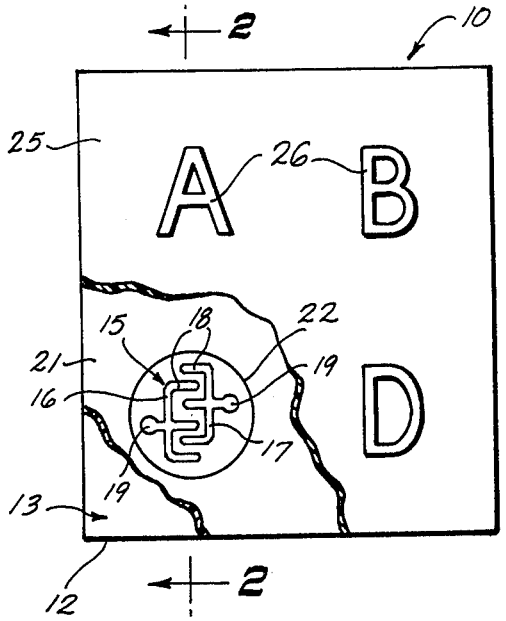
FIG. 1 shows a top view of a membrane type keyboard apparatus according to the present invention with portions cut away.
Figure 3:
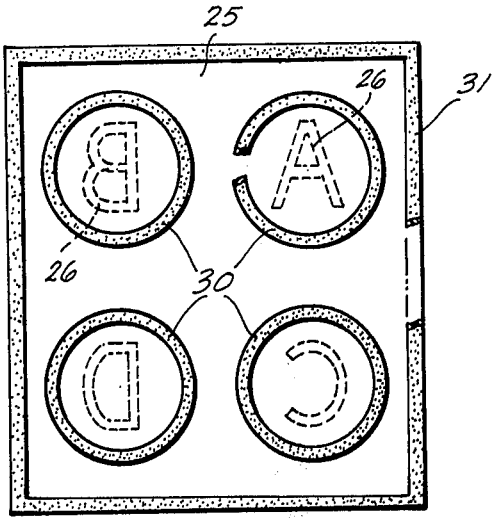
FIG. 3 is a bottom view of the membrane forming a part of the apparatus shown in FIG. 1.
Figure 2:
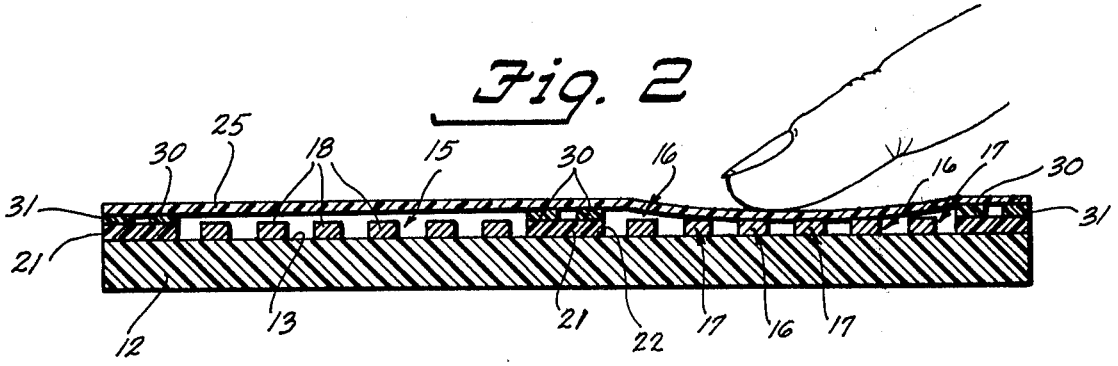
FIG. 2 is a view taken along line 2—2 of FIG. 1.

As used herein, the terms "conductive" and "nonconductive" refer to electrical conductivity. Referring to FIGS. 1–3, a membrane type keyboard switch 10 generally comprises a nonconductive substrate 12 having a planar top surface 13. One or more electrode pairs 15 may be disposed on the substrate surface 13. Each electrode pair 15 includes a first electrode member 16 and a second electrode member 17 having interdigitated spaced fingers 18. Each electrode 16 and 17 may be provided with a terminal 19 which may be coupled to suitable electrical conductors (not shown) on the opposite side of substrate 12 by a suitable conductor (not shown) extending through the substrate 12. Such conductors and the interconnection with the electrodes 16 and 17 are well known in the art and need not be described in detail. It will suffice to say that the interconnection could be a pin member, or they could be formed by any suitable method such as filling connecting holes with solder, sucking conductive paste or plating through the holes, as is well known in the art. The bottom electrical conductors could then be coupled to suitable leads (not shown) for connection to electrical circuitry. The substrate surface 13 also includes a sheet of material 21 having one or more apertures 22 formed therein. An electrode pair 15 is disposed within each aperture 22 and is electrically isolated therefrom. In the preferred embodiment, the sheet 21 and electrode pairs 15 may be formed on the substrate by any suitable techniques such as by adhesively bonding a continuous sheet of conductive material and then by etching away portions of the sheet 21 to form the apertures 22 and electrode pairs 15 in the desired pattern. This technique will produce the configuration shown in FIG. 2 wherein the top surface of the electrode pairs 15 is coplanar with the top surface of the surrounding conductive sheet 21. Finally, the membrane switch 10 includes a sheet-like membrane of resilient material 25 which overlays sheet 21 and the electrode pairs 15. The membrane sheet 25 may have indicia 26 applied to its exposed top surface adjacent the electrode pairs for designating the switching areas of the membrane switch 10. A suitable bezel (not shown) may be provided to form a framework over the membrane 25 and around indicia 26, or the membrane switch 10 could be incorporated in an assembly having individual pushbutton actuators or the like.

Membrane 25 is preferably a thin, flexible sheet member having a high strength to mass ratio. The membrane 25 may be formed of a metallic, electrically conductive sheet or it may also be formed of a flexible plastic, for example polyester such as sold under the trade name Mylar, having its bottom surface coated with a conductive material such as a conductive plastic paint. Membrane 25 should be of sufficient rigidity to prevent the membrane from sagging and contacting the electrode pairs 15, however, it should be of sufficient flexibility to be easily deflected.

With reference to FIGS. 2 and 3, the conductive bottom surface of membrane 25 is held in a spaced relationship from the top surfaces of the electrode pairs 15 by painted spacers or support members 30. The painted spacers 30 may take the form of an annulus which surrounds each of the apertures 22. Additionally, the periphery of membrane 25 may have a spacer 31 painted thereon and supporting the edge of the membrane 25 on sheet 21. The annuli 30 and peripheral spacer 31 may be formed by applying a nonconductive paint or resin such as epoxy, acrylic, polyester or enamel or other suitable nonconductive paints or resins. The paint merely need be viscous enough to retain the desired shape until it drys or is cured on the membrane surface. The paint may be applied in any well known manner such as by screen painting. Another technique would be the use of a mold deposition method in which a mold having a predetermined pattern of apertures corresponding to the desired paint pattern is applied to membrane and paint applied by squeezing it through the apertures onto the membrane surface. The paint could also comprise an ultra-violet curable resin. It will also be apparent that the painted spacers 30 and 31 could also be applied to the surface of sheet 21 rather than to the membrane 25. Additionally, the painted spacers, if applied to sheet 21, could be formed of a suitable nonconductive glass material which would then be cured by firing in a conventional manner. Naturally this would require a high temperature substrate and sheet 21. Membrane 25 may be maintained in place over the substrate 12 and electrodes 15 in any suitable manner such as by adhesive or by suitable physical retaining means. In operation, the membrane 25 may be selectively depressed by any suitable means such as a finger as seen in FIG. 2, to press the conductive surface of membrane 25 into bridging contact with the electrode fingers 18 to bridge the individual electrodes 16 and 17. By suitably connecting the electrodes 16 and 17 to electrical circuitry, a switch is thus provided.

The paint or glass spacers 30 and 31 preferably have a thickness of from 2–8 mils (0.00508–0.02032 cm). The spacers could be thicker if the material used is sufficiently viscous to maintain a greater heighth until it is cured. In any case, the paint or glass thickness should be sufficient to support membrane 25 in a normally spaced relationship from the electrode pairs 15. The sensitivity of the switch, that is the pressure required to deflect the membrane sufficiently to bridge the electrode members 16 and 17 will increase as the paint or glass thickness increases and may thus be varied from no sensitivity, i.e. when the membrane is in continual contact with the electrode pairs, upwardly as the spacer thickness is increased. It has been found that to insure the membrane 25 remains spaced from electrodes 16 and 17, a minimum thickness of approximately 2 mils (0.00508 cm) should be utilized. A further reason for forming the spacers at least 2 mils thickness is that in conventional membrane switch applications such as in a keyboard device, the use of a sharp instrument, such as a ball point pen, to actuate the switches may result in permanent indentation in the membrane which could extend outwardly into the space between the membrane and the electrodes. In the case of Mylar or polyester membranes, it has been found that such an indentation may approximate 2 mils which would then short the switch out. While the conductive sheet 21 has been described as having a top surface which is coplanar with the top surface of the electrodes 16 and 17, differential heights could also be utilized as long as membrane 25 is supported by spacers 30 out of contact with at least one of the electrodes 16 and 17 of each pair 15.

Figure 4:
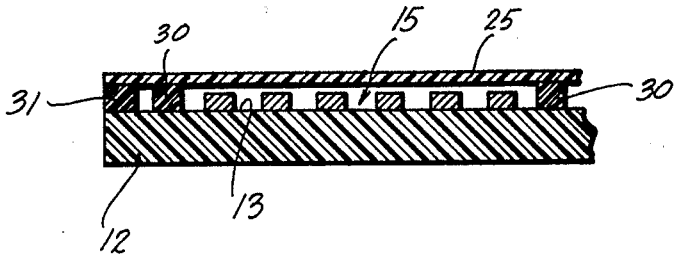
FIG. 4 is a partial, sectional view similar to FIG. 2 of an alternative embodiment of the invention.

As seen in FIG. 4, sheet 21 may be eliminated entirely. In the embodiment shown in FIG. 4, the substrate 12 has electrode members 15 applied thereto as previously described. The membrane 25 is supported over the electrode pairs 15 by spacers 30 and 31 which are interposed directly between the membrane 25 and the top surface 13 of substrate 12. Again, the painted spacers 30 and 31 could be applied either to the bottom surface of membrane 25 or to the top surface 13 of substrate 12 and could consist of either paint or glass as previously described. Obviously, the only requirement is that the spacers 30 and 31 be of sufficient thickness to support the membrane 25 out of contact with the electrode pairs 15. Furthermore, in either of the embodiments, the peripheral spacer 31 could be eliminated as long as spacers 30 are provided to maintain the membrane 25 out of contact with the electrodes 15.

Figure 5:
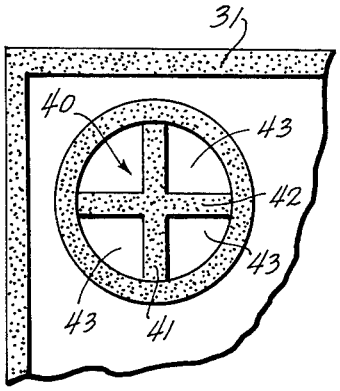
FIG. 5 is a partial bottom view of a modified membrane as shown in FIG. 3.
Figure 6:
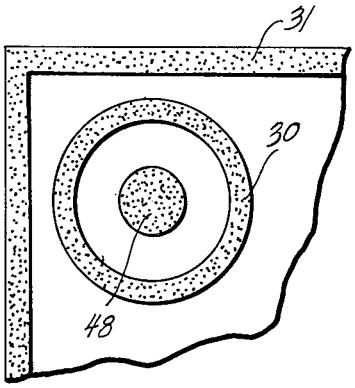
FIG. 6 is a partial, bottom view of an alternate modified membrane as shown in FIG. 3.

Referring now to FIG. 5, a switch threshold member 40 may be applied to the membrane 25 within each of the annuli 30. Threshold member 40 may comprise a nonconductive paint applied within annulus 30 and is shown in FIG. 5 as having a first diameter line 41 and an intersecting diameter line 42 which divides the interior of the annulus 30 into exposed portions 43 of the membrane 25. It will thus be appreciated that the threshold member 40 lies directly in the path of membrane movement into contact with electrode pairs 15 and impedes the bridging contact with the individual electrodes 16 and 17. Provision of the threshold member 40 thus requires a greater degree of pressure on membrane 25 in order to bridge the electrodes 16 and 17. The amount of threshold pressure required will vary depending on the area of the nonconductive threshold member 40, and upon the thickness of the threshold member 40. Preferably, the threshold member 40 comprises a thin, paint pattern having a thickness of approximately 1 mil, however, the thickness would vary depending upon the membrane resiliency and the desired threshold pressure. Obviously, both threshold member 40 and spacer 30 could be applied to the membrane surface 25 or the spacer 30 could be applied to the substrate 12 or the sheet 21 with the threshold member 40 applied to the membrane 25. Additionally, a threshold member could take other forms such as a dot 48 within annulus 30 as shown in FIG. 6.

Figure 7:
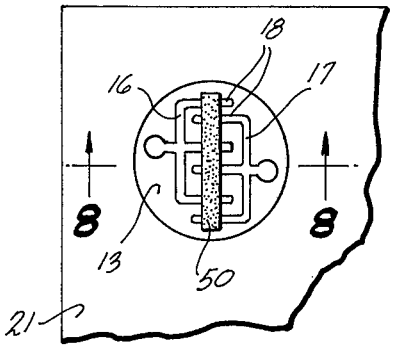
FIG. 7 is a partial, top view of a modified substrate and an electrode pair.
Figure 8:
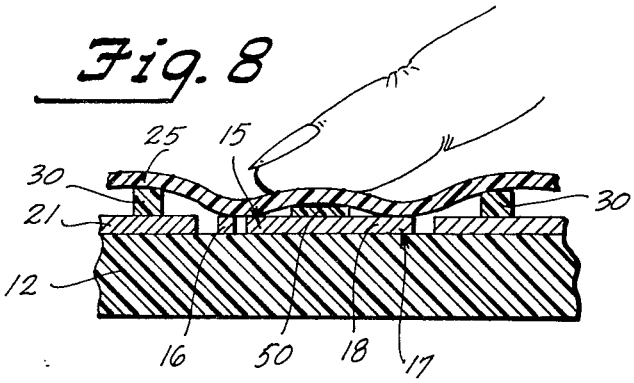
FIG. 8 is a view taken along line 8—8 of FIG. 7.

Referring to FIGS. 7 and 8, a threshold member 50 may be applied directly to the electrode members 16 and 17. In this instance threshold member 50 is shown as comprising a single bar of material extending transversely over the interdigitated electrode fingers 18. As shown in FIG. 8, threshold member 50 prevents membrane 25 from initially contacting the electrical fingers 18 until sufficient pressure by a finger deflects the membrane 25 around threshold member 50 into bridging contact with the electrode fingers 18. As is also seen in FIG. 8, painted spaces 30 as previously described may be utilized.

Figure 9:
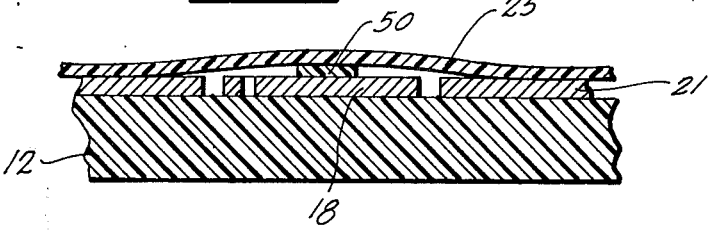
FIG. 9 is a partial, sectional view similar to FIG. 8 of an alternate construction of a membrane switch.

Referring now to FIG. 9, the threshold member 50 could be provided on electrode fingers 18 as shown in FIG. 7 without the use of spacers 30. In this case, the thickness of threshold member 50 should be adequate to support membrane 25 normally out of contact with the electrodes 15 while exposing sufficient areas of the fingers 18 for contact with the membrane 25. Again, the threshold pressure required to bridge the electrode fingers 18 will depend upon the threshold member 50 and the area of the electrode pairs 15 covered. Obviously, the threshold member 50 could be applied either to the electrode directly or to the membrane 25.

Figure 10:
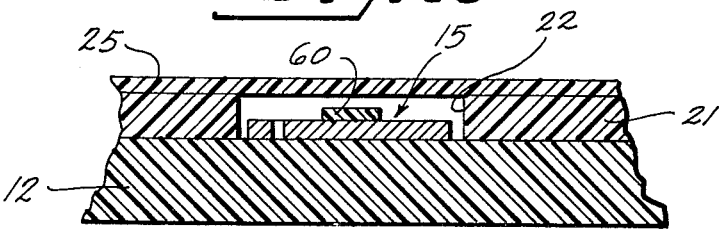
FIG. 10 is a view similar to FIG. 9 of another construction of a membrane switch.

Another variation of the threshold device is shown in FIG. 10. In this case, substrate 12 has electrodes 15 applied thereto and sheet 21 has apertures 22 to receive the electrode pairs 15. In this instance, the top surface of sheet 21 is of a heighth that is greater than the tops of electrode pairs 15 whereby membrane 25 is supported out of contact with the electrode pairs 15 directly on the surface of sheet 21. Again a threshold member 60 may be applied to the electrode pairs 15 as shown in FIG. 10 or it could be applied to the surface of membrane 25.

While several embodiments of the invention have thus been described, it will be appreciated by those skilled in the art that numerous other variations may be possible without departing from the teachings herein. For example, although the electrodes 15 have been described as having interdigitated fingers, they could take other interleaved configurations such as spirals or other forms as are used in the art. Furthermore, a single electrode could be utilized within each of the apertures 22 and the sheet 21 would then be formed of a conductive material with the area of sheet 21 surrounding the electrode member forming one common electrode and the single electrode contained in the aperture 22 forming the second electrode. Obviously either the spacer 30 or the threshold members, or both could be utilized by suitable design techniques. In such an instance, the spacers 30 would have to be set back from the edges of the apertures 22 to provide sufficient area to be bridged by membrane 25. Additionally, a single electrode could be used with a nonconductive sheet 21 and the membrane 25 could form the second electrode by suitable electrical connections as is well known in the art. Again, either spacers or threshold members or both could be employed. Finally, spacers 30 could take any suitable form such as a film conforming to the shape of sheet 21. Accordingly, the scope of the invention is not to be limited by the foregoing description but is to be taken solely by an interpretation of the claims which follow.

I claim:

1. Membrane switch apparatus for accepting input signals from the touch of a user and for providing output signals for use with an electrical circuit comprising:

a nonconductive substrate having a generally planar top surface;

at least one first electrode means supported on the top surface of the substrate;

at least one second electrode means supported by the top surface of the substrate and spaced from and electrically isolated from the first electrode means;

flexible membrane means supported adjacent the first and second electrode means for selectively being deflected to bridge and electrically couple the first and second electrode means;

spacer means disposed between the membrane means and the substrate top surface for supporting the membrane means in a normally spaced relationship relative to at least one of the first and second electrode means, the spacer means comprising a viscous nonconductive material applied while in a liquid state and permitted to solidify;

nonconductive threshold means disposed between the path of movement of the membrane means and the first or second electrode means for requiring a threshold pressure to be applied to the membrane before bridging occurs, said threshold means comprising a nonconductive paint or resin material applied while in a liquid state and permitted to solidify, said material partially masking the contact area between the membrane means and the first or second electrode means; and means for electrically connecting the first and second electrode means to the electrical circuit.

2. The apparatus of claim 1 wherein the spacer means is attached to the membrane means.

3. The apparatus of claim 1 wherein the spacer means is attached to the substrate top surface.

4. The apparatus of claim 1 wherein the spacer means is attached to the first electrode means while maintaining a portion of the first electrode means exposed to contact with the membrane means upon deflection.

5. The apparatus of claim 1 wherein:

the membrane having an electrically conductive surface adjacent the first and second electrode means whereby deflection of the membrane will cause the conductive surface to electrically bridge the first and second electrode means.

6. The apparatus of claim 5 wherein a plurality of first and second electrode means form an array of individual switch units on the substrate top surface.

7. The apparatus of claim 1 wherein the threshold material is attached to the conductive surface of the membrane means.

8. The apparatus of claim 1 wherein the threshold material is attached to at least one of said first or second electrode means.

9. The apparatus of claim 1 wherein a plurality of first and second electrode means form an array of individual switch units on the substrate top surface.

10. The apparatus of claim 1 wherein the threshold material is attached to the conductive surface of the membrane means.

11. The apparatus of claim 1 wherein the threshold material is attached to at least one of said first or second electrode means.

12. Membrane switch apparatus for accepting input signals from the touch of a user and for providing output signals for use with an electrical circuit comprising:

a nonconductive substrate having a generally planar top surface;

at least one first electrode means supported on the top surface of the substrate;

at least one second electrode means supported by the top surface of the substrate and spaced from and electrically isolated from the first electrode means;

flexible membrane means supported adjacent the first and second electrode means for selectively being deflected to bridge and electrically couple the first and second electrode means;

nonconductive threshold means disposed between the path of movement of the membrane means and the first or second electrode means for requiring a threshold pressure to be applied to the membrane before the first and second electrode means are electrically coupled, said threshold means comprising a nonconductive paint or resin material applied while in a liquid state and permitted to solidify, said material partially masking the contact area between the membrane means and the first or second electrode means; and means for electrically connecting the first and second electrode means to the electrical circuit.

13. The apparatus of claim 12 wherein the threshold material is attached to the membrane means.

14. The apparatus of claim 12 wherein the threshold material is attached to at least one of said first or second electrode means.

15. The apparatus of claim 12 wherein:

the membrane having an electrically conductive surface adjacent the first and second electrode means whereby deflection of the membrane will cause the conductive surface to electrically bridge the first and second electrode means.

16. The apparatus of claim 15 wherein a plurality of first and second electrode means form an array of individual switch units on the substrate top surface.

17. The apparatus of claim 12 including spacer means for supporting the membrane means in a normally spaced relationship relative to at least one of the first and second electrode means.

* * * * *